US006880415B2

(12) United States Patent
Nito

(10) Patent No.: US 6,880,415 B2
(45) Date of Patent: Apr. 19, 2005

(54) STARTER HAVING INTERMEDIATE GEAR FOR CRANKING INTERNAL COMBUSTION ENGINE

(75) Inventor: Kuniaki Nito, Kariya (JP)

(73) Assignee: Denso Corporation, Kariya (JP)

( * ) Notice: Subject to any disclaimer, the term of this patent is extended or adjusted under 35 U.S.C. 154(b) by 120 days.

(21) Appl. No.: 10/342,264

(22) Filed: Jan. 15, 2003

(65) Prior Publication Data

US 2003/0154808 A1 Aug. 21, 2003

(30) Foreign Application Priority Data

Feb. 15, 2002 (JP) ..... 2002-037724

(51) Int. Cl.[7] ..... F02N 15/06
(52) U.S. Cl. ..... 74/6; 74/7 A; 74/7 E
(58) Field of Search ..... 74/6, 7 A, 7 B, 74/7 E, 7 R

(56) References Cited

U.S. PATENT DOCUMENTS 5,165,293 A * 11/1992 Kittaka et al. ..... 74/7 A
5,258,674 A 11/1993 Sakamoto et al.
5,277,075 A * 1/1994 Sakamoto et al. ..... 74/7 R
5,706,699 A 1/1998 Moribayashi
5,895,993 A * 4/1999 Kajino et al. ..... 310/83
6,647,812 B1 * 11/2003 Nito et al. ..... 74/6
2002/0069713 A1 6/2002 Nito et al.

FOREIGN PATENT DOCUMENTS

JP A 7-293408 11/1995
JP A 2002-147324 5/2002

* cited by examiner

*Primary Examiner*—William C. Joyce
*Assistant Examiner*—Julie K. Smith
(74) *Attorney, Agent, or Firm*—Oliff & Berridge, PLC

(57) ABSTRACT

A starter includes an electric motor, a pinion gear driven by the electric motor, and an intermediate gear driven by the pinion gear. The intermediate gear is coupled to the pinion gear by a coupler member in order to shift the intermediate gear toward a ring gear of an engine together with the pinion gear in a cranking operation. When the starter is not in operation, the intermediate gear is positioned at its rest position where a biasing force is applied to the intermediate gear to push it against the coupler member. Vibrant movement of the intermediate gear relative to the coupler member due to engine vibrations is prevented by the biasing force.

3 Claims, 2 Drawing Sheets

STARTER HAVING INTERMEDIATE GEAR FOR CRANKING INTERNAL COMBUSTION ENGINE

CROSS-REFERENCE TO RELATED APPLICATION

This application is based upon and claims benefit of priority of Japanese Patent Application No. 2002-37724 filed on Feb. 15, 2002, the content of which is incorporated herein by reference.

BACKGROUND OF THE INVENTION

1. Field of the Invention

The present invention relates to a starter having an intermediate gear that is engaged with a ring gear of an internal combustion engine in a cranking operation.

2. Description of Related Art

An example of a starter having an intermediate gear is disclosed in JP-B2-2555492. In this starter, an intermediate shaft is disposed in parallel to an output shaft supporting a pinion gear thereon. An intermediate gear always engaging with the pinion gear is rotatably supported by the intermediate shaft. The pinion gear and the intermediate gear are coupled by a coupler member so that the intermediate gear shifts in its axial direction in accordance with an axial movement of the pinion gear. In a cranking operation, the intermediate gear is shifted toward a ring gear of an internal combustion engine, and a rotational torque of the pinion gear is transmitted to the ring gear via the intermediate gear.

The coupler member is coupled with the intermediate gear with a certain clearance in the axial direction in order to allow rotation of the intermediate gear relative to the coupler member while maintaining engagement with the pinion gear. Therefore, there is a problem that the intermediate gear vibrantly moves in its axial direction due to vibrations of the engine when the starter is not in operation. Such vibrant movement of the intermediate gear generates chattering noises and abrasion between the intermediate gear and the coupler member.

SUMMARY OF THE INVENTION

The present invention has been made in view of the above-mentioned problem, and an object of the present invention is to provide an improved starter having an intermediate gear, in which vibrant movement of the intermediate gear is suppressed.

The starter includes an electric motor powered by an on-board battery, a pinion gear driven by the electric motor, and an intermediate gear supported by an intermediate shaft disposed in parallel to an output shaft of the electric motor. The pinion gear is connected to the output shaft of the electric motor via a one-way clutch so that a rotational torque of the electric motor is transmitted to the pinion gear while preventing torque transmission from the pinion gear to the electric motor. The intermediate gear is coupled to the pinion gear by a coupling member so that the intermediate gear shifts in its axial direction together with an axial movement of the pinion gear. The intermediate gear always engages with the pinion gear and is driven by the pinion gear.

To crank up an internal combustion engine, the intermediate gear is shifted in its axial direction to be engaged with a ring gear of the engine. The engine is cranked up by the rotational torque of the electric motor transmitted via the pinion gear and the intermediate gear. After the engine is cranked up, the electric motor is stopped and the intermediate gear returns to its original rest position.

When the starter is not in operation and the intermediate gear is positioned at its rest position, a biasing force is applied to the intermediate gear to push it toward the coupler member. Preferably, a coil spring is disposed at a rear end of the intermediate gear for applying such a biasing force. The coil spring is able to generate a stable biasing force and is easily disposed at the rear end of the intermediated gear. A flange may be formed at the rear end of the intermediate gear, and the biasing force of the coil spring may be applied to a washer interposed between the flange and the coil spring.

Since the intermediate gear is pushed against the coupler member when the starter is not in operation, vibrant movement of the intermediated gear relative to the coupler member is suppressed. Accordingly, chattering noises and abrasion between the intermediate gear and the coupler member are effectively suppressed.

Other objects and features of the present invention will become more readily apparent from a better understanding of the preferred embodiment described below with reference to the following drawings.

DETAILED DESCRIPTION OF THE PREFERRED EMBODIMENT

Figure 1:
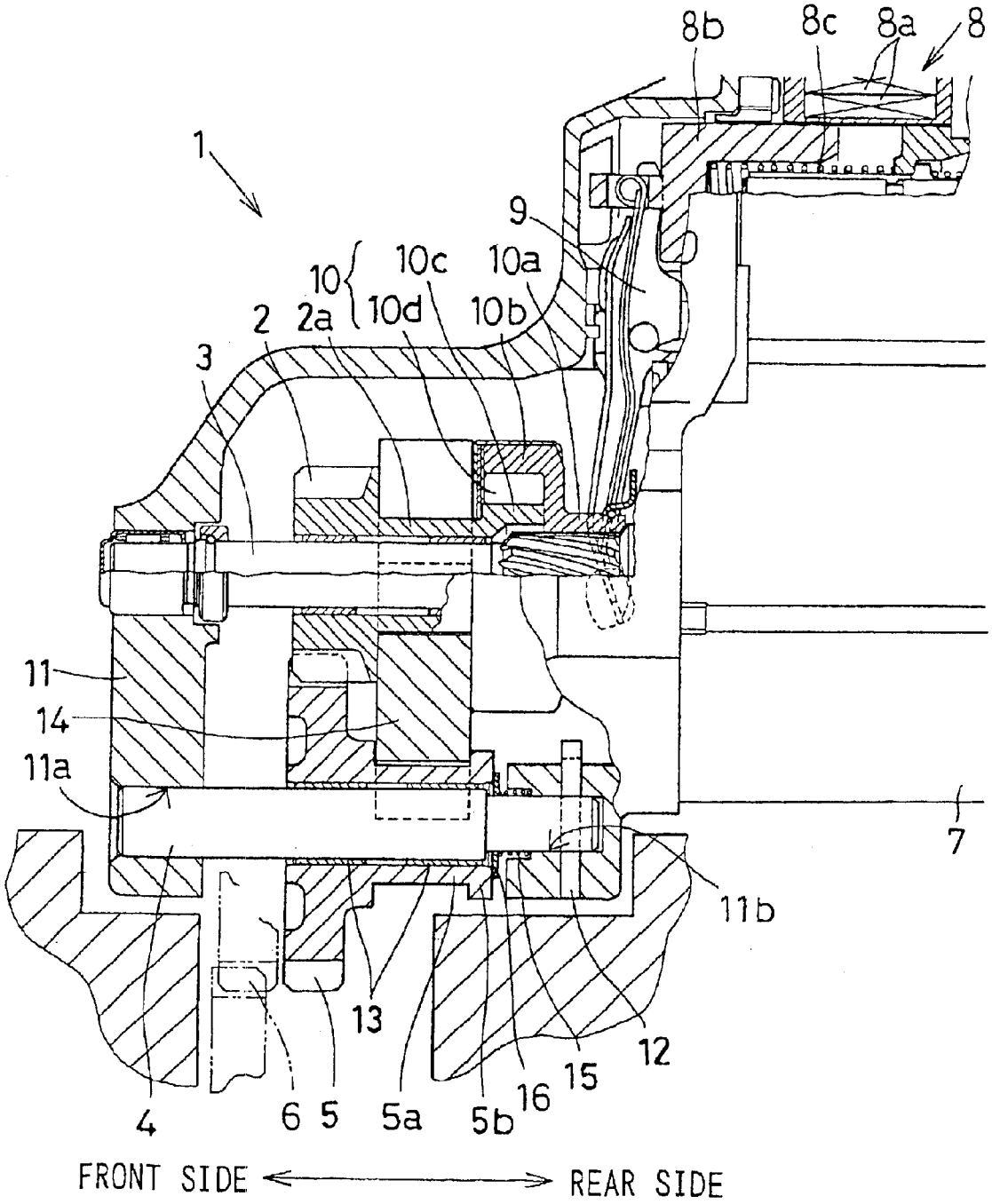
FIG. 1 is a cross-sectional view showing a part of a starter according to the present invention.

A preferred embodiment of the present invention will be described with reference to accompanying drawings. First, referring to FIG. 1, a structure of a starter having an intermediate gear adapted to be engaged with a ring gear of an engine will be described. The starter 1 includes an electric motor 7 powered by an on-board battery, a speed reduction mechanism (not shown), a one-way clutch 10, an output shaft 3, a pinion gear 2 supported by the output shaft 3, an intermediate shaft 4, and an intermediate gear 5 supported by the intermediate shaft 4. A front side and a rear side of the starter 1 are shown in FIG. 1 in order to refer to them in the following description.

The output shaft 3 is disposed coaxially with an armature shaft (not shown) of the electric motor 7 and connected to the armature shaft through the speed reduction mechanism. Rotation of the armature shaft is transmitted to the output shaft 3 after a rotational speed of the armature shaft is reduced by the speed reduction mechanism. The electric motor 7 is a known type of a direct current electric motor. Electric power is supplied to the electric motor 7 from an on-board battery when an electromagnetic switch 8 is closed.

The electromagnetic switch 8 includes an electromagnetic coil 8*a*, a plunger 8*b* to be driven to the rear side of the starter 1 when the electromagnetic coil 8*a* is energized, a return spring 8*c* biasing the plunger 8*b* toward the front side, and motor contacts that are closed when the electromagnetic coil 8*a* is energized. One end of a lever 9 pivotally supported in a housing 11 is connected to the plunger 8*b*. When the electromagnetic coil 8*a* is energized, the one-way clutch 10 is driven by the lever 9 toward the front side together with the pinion gear 2.

The one-way clutch 10 is composed of an outer ring 10*b*, an inner ring 10*c* and rollers 10*d* disposed between both rings 10*b*, 10*c*. A barrel portion 10*a* formed integrally with the outer ring 10*b* is coupled to the output shaft 3 by means of helical spline connection. The pinion gear 2 is formed integrally with its cylindrical portion 2*a* and the inner ring 10*c* of the one-way clutch 10. The one-way clutch 10 transmits a rotational torque of the output shaft 3 to the pinion gear 2 while interrupting torque transmission from the pinion gear 2 to the output shaft 3.

Figure 3A:
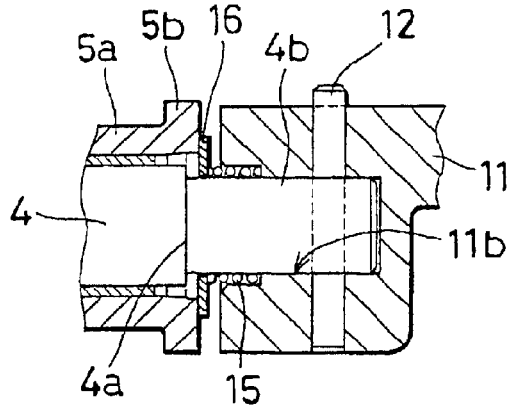
FIG. 3A is a partial cross-sectional view of the starter, showing a state of biasing members when the starter is not in operation.

The intermediate shaft 4 is inserted at its both ends into supporting holes 11*a*, 11*b* formed in the housing 11 and fixed to the housing by a pin 12. The intermediate shaft 4 includes a rear end portion 4*b* (shown in FIG. 3A) having a diameter smaller than a diameter of its main portion. A stepped surface 4*a* is formed at a boundary of the rear end portion 4*b* and the main portion, as shown in FIG. 3A. The pin 12 is inserted through the rear end portion 4*b* and fixed to the housing 11. The intermediate shaft 4 is connected to the housing 11 so that it neither rotates nor moves in the axial direction.

The intermediate gear 5 has a cylindrical sleeve 5*a* and a flange 5*b*, all being integrally formed. The flange 5*b* having a larger diameter is formed at the rear end of the cylindrical sleeve 5*a*. The intermediate gear 5 is supported by the intermediate shaft 4 with bearings 13 interposed therebetween, so that the intermediate gear 5 is slidably movable in the axial direction and rotatable around the intermediate shaft 4. The cylindrical portion 2*a* of the pinion gear 2 and the cylindrical sleeve 5*a* of the intermediate gear 5 are coupled by a coupler member 14. The coupler member 14 is held in grooves formed on the cylindrical portion 2*a* and the cylindrical sleeve 5*a*. Thus, the intermediate gear 5 is slidable in its axial direction according to an axial movement of the pinion gear 2, while maintaining engagement of the intermediate gear 5 with the pinion gear 2. A washer 16 and a coil spring 15 are disposed at the rear end of the flange 5*b*, so that the intermediate gear 5 is biased toward the front side when the starter 1 is not in operation.

Figure 2:
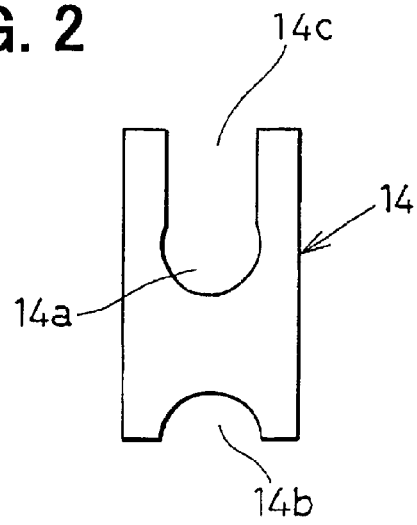
FIG. 2 is a plan view showing a coupler member used in the starter shown in FIG. 1.

The coupling member 14 is made of a resin material and has a uniform thickness in its axial direction. As shown in FIG. 2, the coupling member 14 has a first groove 14*a* that slidably engages with the cylindrical portion 2*a* of the pinion gear 2 and a second groove 14*b* that slidably engages with the cylindrical sleeve 5*a* of the intermediate gear 5. The first groove 14*a* is connected to an opening 14*c* through which the cylindrical portion 2*a* is coupled to the first groove 14*a*. The thickness of the coupler member 14 is made a little smaller than the width of the grooves formed on the cylindrical portion 2*a* and the cylindrical sleeve 5*a* in order to provide a small axial clearance between the coupler member 14 and the grooves. The coupler member 14 restricts relative movement between the pinion gear 2 and the intermediate gear 5 in the axial direction and allows rotation of both gears 2, 5 relative to the coupler member 14.

Figure 3B:
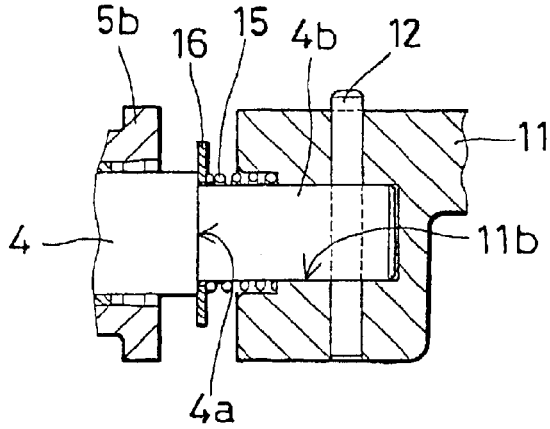
FIG. 3B is a partial cross-sectional view of the starter, showing a state of the same biasing members as shown in FIG. 3A when the starter is in operation.

Referring to FIGS. 3A and 3B, the biasing function of the coil spring 15 will be described. FIG. 3A shows a situation where the starter 1 is not in operation, i.e., the intermediate gear 5 is positioned at its rest position. (The rest position is also shown in FIG. 1.) At the front end of the supporting hole 11*b*, a circular space for disposing the coil spring 15 therein is formed. The washer 16 is disposed to abut the rear end of the flange 5*b*, and the coil spring 15 is disposed to bias the intermediate gear 5 toward the front side. Because an axial space is provided between the rear end of the flange 5*b* and the stepped surface 4*a*, the washer 16 does not abut the stepped surface 4*a*. The biasing force of the coil sprig 15 is set to a level lower than the biasing force of the return spring 8*c* in the electromagnetic switch 8 in order not to push the intermediate gear 5 to the front side when the electromagnetic switch 8 is not energized.

FIG. 3B shows a situation where the starter 1 is in operation, i.e., the intermediate gear 5 is pushed frontward by the lever 9 driven by the electromagnetic switch 8. Under this situation, the washer 16 abuts the stepped surface 4*a* of the intermediate shaft 4, not abutting the flange 5*b* of the intermediate gear 5. Therefore, the biasing force is not given to the intermediate gear 5.

Now, operation of the starter 1 will be described. Upon energization of the electromagnetic coil 8*a*, the plunger 8*b* is pulled toward the rear side, and the one-way clutch 10 is slidably pushed to the front side together with the pinion gear 2 by the lever 9 connected to the plunger 8*b*. According to the frontward movement of the pinion gear 2, the intermediate gear 5 coupled to the pinion gear 2 by the coupler member 14 is pushed frontward while keeping the engagement with the pinion gear 2. The biasing force of the coil spring 15 is applied to the intermediate gear 5 until the washer 16 abuts the stepped surface 4*a* of the intermediate shaft 4.

After the intermediate gear 5 abuts the ring gear 6 of the engine, the plunger 8*b* is further driven to the rear side, thereby closing the motor contacts. When the motor contacts are closed, the electric motor 7 is operated and the output shaft 3 is rotated. The rotational torque of the output shaft 3 is transmitted to the pinion gear 2 via the one-way clutch 10. The intermediate gear 5 engaging with the pinion gear 2 rotates to an angular position where engagement of the intermediate gear 5 with the ring gear 6 is allowed. Upon establishment of the engagement between the intermediate gear 5 and the ring gear 6, the rotational torque of the electric motor 7 is transmitted to the ring gear 6 to thereby crank up the engine. During a period in which the engine is being cranked, the biasing force of the coil spring 15 is not applied to the intermediate gear 5. Therefore, the intermediate gear 5 is able to rotate without receiving the biasing force of the coil spring 15, and abrasion between the intermediate gear 5 and the coupler member 14 does not occur.

After the engine is cranked up, the electromagnetic coil 8*a* is de-energized. The plunger 8*b* is returned to its original rest position by the return spring 8*c*, and thereby the one-way clutch 10 is also returned to its rest position together with the pinion gear 2. The intermediate gear 5 coupled to the pinion gear 2 returns to its rest position while maintaining its engagement with the pinion gear 2. At this rest position, as shown in FIG. 3A, the biasing force of the coil spring 15 is applied to the intermediate gear 5 via the washer 16. Accordingly, the flange 5*b* of the intermediate gear 5 is pushed against the coupler member 14, thereby establishing a close contact between the intermediate gear 5 and the coupler member 14.

Following advantages are achieved in the embodiment described above. The biasing force of the coil spring 15 is applied to the intermediate gear 5 via the washer 16 when the intermediate gear 5 is at the rest position, i.e., when the starter 1 is not in operation. Therefore, the intermediate gear

5 is pushed against the coupler member 14, and the axial movement of the intermediate gear 5 is restricted. As a result, chattering noises of the intermediate gear 5 due to vibrations of the engine are suppressed, and abrasion wear of the intermediate gear 5 and the coupler member 14 is suppressed.

During a course in which the intermediate gear 5 is returning to the rest position after the engine is cranked up, the intermediate gear 5 still continues rotation by its inertia. When the flange 5*b* of the intermediate gear 5 abuts the washer 16, the biasing force of the coil spring 15 is applied to the intermediate gear 5. Therefore, the rotational speed of the intermediate gear 5 by its inertia is reduced by the biasing force of the coil spring 15. If the starter 1 is operated again by a driver's error while the intermediate gear 5 is still rotating, and the intermediate gear 5 abuts the ring gear 6, the ring gear 6 and the intermediate gear 5 are prevented from being damaged by such an erroneous operation because the rotational speed of the intermediate gear 5 is reduced by the biasing force of the coil spring 15.

The biasing force of the coil spring 15 is applied to the intermediate gear 5 in a frontward direction when the starter 1 is not in operation, as shown in FIG. 3A. Therefore, when the starter 1 is put into operation and the intermediate gear 5 initiates its frontward movement, the biasing force of the coil spring 5 helps such frontward movement at the initial stage. As a member to generate the biasing force, a resilient member other than the coil spring 15 may be used. However, it is preferable to use the coil spring 15, because it can be easily disposed in the circular space formed in the housing 11, and a stable biasing force can be obtained form the coil spring.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter for cranking an internal combustion engine, the starter comprising:

an electric motor having an output shaft;

a pinion gear supported by the output shaft and driven by the electric motor;

an intermediate shaft disposed in parallel to the output shaft;

an intermediate gear supported by the intermediate shaft, the intermediate gear always engaging with the pinion gear;

a coupler member coupling the pinion gear and the intermediate gear so that the intermediate gear slides on the intermediate shaft to be engaged with a ring gear of the engine in accordance with an axial movement of the pinion gear to thereby transmit a rotational torque of the pinion gear to the ring gear via the intermediate gear, wherein:

the starter includes means for biasing the intermediate gear in its axial direction against the coupler member, when the starter is not in operation, to thereby restrict an axial movement of the intermediate gear relative to the coupler member.

2. The starter as in claim 1, wherein:

the intermediate gear includes a cylindrical sleeve extending to a rear side of the starter and a flange formed at a rear end of the cylindrical sleeve; and the biasing means applies a biasing force to the flange.

3. The starter as in claim 2, wherein the biasing means includes a coil spring.

* * * * *